US009868048B2

(12) United States Patent
Kang

(10) Patent No.: US 9,868,048 B2
(45) Date of Patent: Jan. 16, 2018

(54) SKATEBOARD CAPABLE OF PROVIDING SELF-PROPULSIVE FORCE

(71) Applicant: In Tae Kang, Incheon (KR)

(72) Inventor: In Tae Kang, Incheon (KR)

( * ) Notice: Subject to any disclaimer, the term of this patent is extended or adjusted under 35 U.S.C. 154(b) by 16 days.

(21) Appl. No.: 15/053,104

(22) Filed: Feb. 25, 2016

(65) Prior Publication Data

US 2017/0120138 A1 May 4, 2017

(30) Foreign Application Priority Data

Oct. 30, 2015 (KR) ..... 10-2015-0151519

(51) Int. Cl.

*A63C 17/12* (2006.01)
*A63C 17/01* (2006.01)
*A63C 17/00* (2006.01)

(52) U.S. Cl.

CPC ..... *A63C 17/12* (2013.01); *A63C 17/0006* (2013.01); *A63C 17/011* (2013.01); *A63C 17/015* (2013.01); *A63C 17/017* (2013.01); *A63C 2203/52* (2013.01)

(58) Field of Classification Search

CPC ..... A63C 17/12; A63C 17/017; A63C 17/015; A63C 17/0006; A63C 17/011; A63C 17/1454; A63C 2203/40; A63C 2203/52; B62M 1/00; B62M 1/24; B62M 1/32

See application file for complete search history.

(56) References Cited

U.S. PATENT DOCUMENTS 3,771,811 A * 11/1973 Bueno ..... A63C 17/01 280/87.042
4,181,319 A * 1/1980 Hirbod ..... A63C 17/12 280/11.115
4,202,559 A * 5/1980 Piazza, Jr. ..... A63C 17/013 280/11.27
5,224,719 A * 7/1993 Goodspeed ..... A63C 17/01 280/11.115
5,236,208 A * 8/1993 Welsh ..... A63C 17/013 280/11.27

(Continued)

FOREIGN PATENT DOCUMENTS

KR 20-0384634 Y1 5/2005
KR 10-2005-0088978 A 9/2005

(Continued)

*Primary Examiner* — Frank B Vanaman
(74) *Attorney, Agent, or Firm* — IP Legal Services, LLC

(57) ABSTRACT

The skateboard capable of providing the self-propulsive force includes: a board main body; a center rotation portion which allows a user of the skateboard to change a direction of the skateboard with one foot put thereon; a first footrest portion which is provided on one side of the board main body with respect to the center portion and moves the board main body through a left and right reciprocating movement of the footrest; a second footrest portion which is provided on the other side of the board main body with respect to the center portion and moves the board main body through a left/right reciprocating movement of the footrest; and an elastic guide portion which is provided between the board main body and the wheel assemblies and guides left/right reciprocating movements of the support members.

5 Claims, 8 Drawing Sheets

(56) References Cited

U.S. PATENT DOCUMENTS

| | | | | |
|---|---|---|---|---|
| 7,980,573 | B1 * | 7/2011 | Naman | A63C 17/12 280/254 |
| 2003/0155726 | A1 * | 8/2003 | Braun | A63C 5/02 280/14.21 |
| 2005/0280231 | A1 * | 12/2005 | Gallipoli | A63C 17/0086 280/87.042 |
| 2010/0044986 | A1 * | 2/2010 | Dannenberg | A63C 17/004 280/87.042 |
| 2016/0001166 | A1 * | 1/2016 | Kumada | A63C 17/006 280/87.03 |

FOREIGN PATENT DOCUMENTS

| | | | |
|---|---|---|---|
| KR | 10-0687458 | B1 | 3/2007 |
| KR | 10-2009-0005633 | A | 1/2009 |
| KR | 10-2009-0022791 | A | 3/2009 |
| KR | 10-1126427 | B1 | 3/2012 |
| KR | 10-1479197 | B1 | 1/2015 |

* cited by examiner

SKATEBOARD CAPABLE OF PROVIDING SELF-PROPULSIVE FORCE

CROSS REFERENCE TO PRIOR APPLICATIONS

This application claims priority of Korean Patent Application No. 10-2015-0151519, filed on Oct. 30, 2015, in the Korean Intellectual Property Office, which is hereby incorporated by reference in its entirety.

BACKGROUND OF THE INVENTION

Field of the Invention

The present invention relates to a skateboard, and more particularly, to a skateboard which is capable of providing a self-propulsive force and is configured such that a skateboard is propelled by a user's action of repeating spreading and closing movement of his or her feet while putting his or her feet on a footrest installed on a board main body, it is easy to reduce risk of the safety accident and maintain balance, and it is possible to achieve an increase in a moving speed of the skateboard and change a travelling direction of the skateboard to an opposite direction if necessary.

Description of the Related Art

Generally, a skateboard is a type of sports equipment which includes an elongated plate and four wheels attached to the front and rear sides of the elongated plate and is propelled by kicking the ground with one foot. Particularly, the skateboard is a type of play equipment which allows a user to slide down a hill or the like while putting his or her feet on the skateboard.

In other words, the skateboard includes a long elliptical plate and two wheel assemblies on the bottom of the plate. Each of the wheel assemblies has two rollers. According to the related art, in the case of skateboarding on a flatland, the skateboard is propelled by a propulsive force generated when a user kicks the ground with one foot. The user can enjoy skateboarding in such a manner that the user turns the skateboard during skateboarding by tilting the skateboard to a left or right side with respect to a travelling direction of the skateboard with his or her foot or by leaning his or her body.

When the user rides such a skateboard, there is an inconvenience in that the user has to repeatedly kick the ground with one foot while the other foot is put on the skateboard so as to obtain a propulsive force.

In other words, since the user has to repeatedly kick the ground with one foot so as to obtain a continuous propulsive force, the user has to maintain his or her balance with the other foot. Consequently, the balance is easily broken, and thus, risk of the safety accident is high. Furthermore, when the user kicks the ground, the user has to push the ground while continuously moving one foot up and down, and thus, the user easily gets tired.

In addition, when the user rides the skateboard, the user kicks the ground with one foot while the other foot supports the user's body. Therefore, it is difficult for the user to maintain his or her balance when the user kicks the ground or when the user puts one foot on the plate of the skateboard after kicking the ground. Thus, there is a problem in that unskilled persons cannot ride the skateboard.

Moreover, as for the skateboard according to the related art, since the user kicks the ground with one foot while the other foot supports the user, as described above, a speed of the skateboard on a flatland is limited in a certain range (for example, about 10 km to about 15 km). As a result, there is a limitation in enjoying skateboarding at higher speed.

PRIOR ART DOCUMENT(S)

Patent Document (Patent Document 0001) Korean Unexamined Patent Publication No. 10-2009-0005633 (Jan. 14, 2009)

(Patent Document 0002) Korean Unexamined Patent Publication No. 10-2009-0022791 (Mar. 4, 2009)

(Patent Document 0003) Korean Patent Registration No. 10-1479197 (Dec. 29, 2014)

SUMMARY OF THE INVENTION

The present invention has been made in an effort to solve the problems of the related art and an object of the present invention is to provide a skateboard capable of providing a self-propulsive force, wherein the skateboard can solve inconvenience that the user has to repeatedly kick the ground with one foot while the other foot is put on the skateboard so as to obtain a propulsive force.

Another object of the present invention is to provide a skateboard capable of providing a self-propulsive force, wherein the skateboard can reduce risk of the safety accident and can prevent a user from getting easily tired when the user rides the skateboard.

Another object of the present invention is to provide a skateboard capable of providing a self-propulsive force, wherein the skateboard makes it easy for a user to maintain his or her balance when riding the skateboard, and thus any persons can easily enjoy skateboarding regardless of age.

Another object of the present invention is to provide a skateboard capable of providing a self-propulsive force, wherein it is possible to increase a moving speed of the skateboard by increasing a rotating speed of wheels.

Another object of the present invention is to provide a skateboard capable of providing a self-propulsive force, wherein it is possible to change a travelling direction of the skateboard to an opposite direction during skateboarding.

Another object of the present invention is to provide a skateboard capable of providing a self-propulsive force, wherein it is possible to strength a thigh muscle, which is a symbol of good health of adult men and women, by repeating spreading and closing movement of their feet.

Another object of the present invention is to provide a skateboard capable of providing a self-propulsive force, wherein a user frequently changes his or her posture if necessary, and thus, it is possible to perform various posture changes while the user rides the skateboard.

In order to achieve the objects of the present invention, there is provided a skateboard capable of providing a self-propulsive force, the skateboard including: a board main body (100) on which a user stands with his or her feet, wherein an installation recess (112) having a certain depth is formed in a center portion, and guide holes (114) are formed, with the installation recess (112) being interposed between the guide holes (114); a center rotation portion (200) which allows the user of the skateboard to change a direction of the skateboard with one foot put thereon, the center rotation portion (200) including: a rotation plate (210) which is installed in the installation recess (112) of the board main body (100); a support member (220) in which thrust bearings (240) are installed on upper and lower sides of a center portion thereof, and hollow wing portions (222) are integrally formed in both left and right end portions thereof; and a bolt member (230) which passes through the rotation plate (210) and the support member (220) and is fastened to a nut member (232); a first footrest portion (300) which is provided on one side of the board main body (100) with respect to the center portion and moves the board main body (100) through a left and right reciprocating movement of the footrest (310), the first footrest portion (300) including: a footrest (310) which is installed in the guide hole (114) on one side of the board main body (100); a support member (320) in which thrust bearings (350) are installed in upper and lower side of a center portion thereof, and hollow wing portions (322) are integrally formed in both left and right end portions thereof; a bolt member (330) which passes through the footrest (310) and the support member (320) and is fastened to a nut member (360); and a wheel assembly (340) in which a horizontal extension portion (342) in an upper portion is fastened to a lower surface of the support member (320) and wheels (346) are pivotally provided in both left and right end portions of the main body (344) integrally formed with the horizontal extension portion (342); a second footrest portion (400) which is provided on the other side of the board main body (100) with respect to the center portion and moves the board main body (100) through a left/right reciprocating movement of the footrest (410), the second footrest portion (400) including: a footrest (410) which is installed in the guide hole (114) on the other side of the board main body (100); a support member (420) in which thrust bearings (450) are installed in upper and lower sides of a center portion thereof and hollow wing portions (422) are integrally formed in both left and right end portions thereof; a bolt member (430) which passes through the footrest (410) and the support member (420) and is fastened to a nut member (460); and a wheel assembly (440) in which a horizontal extension portion (442) in an upper portion is fastened to a lower surface of the support member (420), and wheels (442) are pivotally provided in both left and right end portions of the main body (444) integrally formed with the horizontal extension portion (442); and an elastic guide portion (500) which is provided between the board main body (100) and the wheel assemblies (340, 440) and guides left/right reciprocating movements of the support members (220, 320, 420).

The both left and right end portions of the board main body (100) are bent and curved upward.

At least one grip hole (116) is provided in an edge portion of the board main body (100) to allow a user to move the skateboard by putting his or her hands in the grip hole (116) and gripping the skateboard.

Synthetic resin bushings (224, 324, 424) are respectively inserted into both left and right end portions of the support members (220, 320, 420), such that a left/right reciprocating movement of the guider (514) is smoothly performed.

The elastic guide portion (500) includes: a core material (512) which has a rod shape and is made of aluminum (Al); a guider (514) which is made of stainless steel (SUS) and into which the core material (512) is inserted; a large coil spring (520) and a small coil spring (522) which respectively surround both outer circumference surfaces of the guider (514); a closure member (530) and a spring accommodation member (540) through which the guider (514) sequentially passes; and a bolt member (550) which is fastened to the guider (514).

The skateboard capable of providing the self-propulsive force according to the present invention can obtain the following effects.

First, the movement of the skateboard is performed by repeating the spreading and closing movement of the feet while the feet are put on the footrests (310, 410) on the board main body (100). Accordingly, it is possible to solve inconvenience that the user has to repeatedly kick the ground with one foot while the other foot is put on the skateboard so as to obtain a propulsive force.

Second, since the user need not continuously kick the ground with one foot, it is possible to reduce risk of the safety accident and prevent the user from getting easily tired when the user rides the skateboard.

Third, since the movement of the skateboard is performed by repeating the spreading and closing movement of the feet while the feet are put on the footrests (310, 410) on the board main body (100), the user can easily maintain his or her balance when riding the skateboard, and thus, any persons can easily enjoy skateboarding regardless of age.

Fourth, the moving speed of the skateboard can be increased by increasing the rotating speed of the wheels (346, 446) by way of rapidly repeating the spreading and closing movement of the foot put on the footrests (310, 410).

Fifth, when the user rides the skateboard, the user can change the travelling direction of the skateboard in an opposite direction in such a manner that the user raises his or her left foot put on the footrest (310) of the first footrest portion (300), puts his or her left foot on the rotation plate (210), turns his or her body by 180 degrees, raises his or her right foot put on the footrest (410) of the second footrest portion (400), and puts his or her right foot on the footrest (310) of the first footrest portion (300).

Sixth, it is possible to strengthen a thigh muscle, which is a symbol of good health of adult men and women, by repeating the spreading and closing movement of feet.

Seventh, since the rotation plate (210) and the footrests (310, 410) have the pivotable structures, the user can frequently turn his or her posture (180 degrees) if necessary, and thus, the user can variously change his or her posture while the user rides the skateboard.

DETAILED DESCRIPTION OF EMBODIMENTS

Hereinafter, a skateboard capable of providing a self-propulsive force according to an embodiment of the present invention will be described in detail.

The terms or words used herein should not be construed as being limited to the typical or dictionary meanings and should be construed as the meanings or concepts corresponding to the technical aspects of the present invention, based on the principle that the inventors are allowed to appropriately define the concept of the terms so as to describe their invention in the best way.

Figure 1:
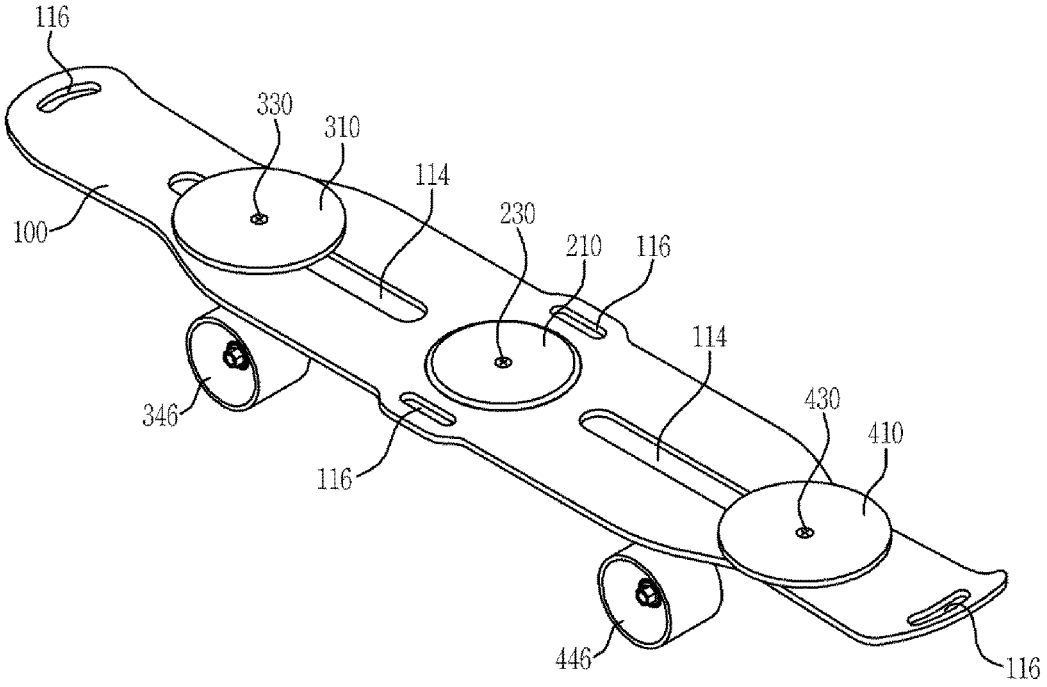
FIG. 1 is a perspective view of a skateboard capable of providing a self-propulsive force according to an embodiment of the present invention.
Figure 2:
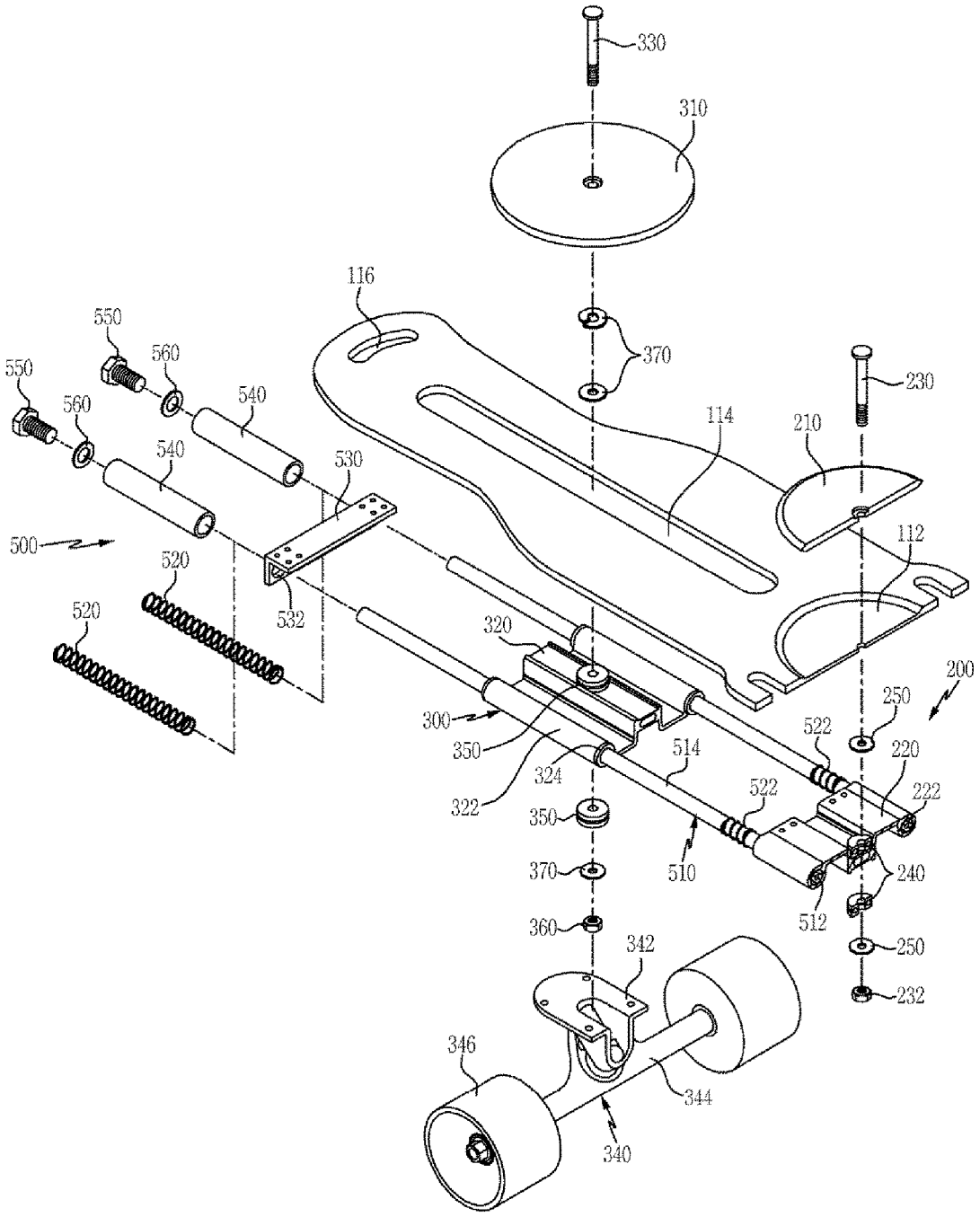
FIGS. 2 and 3 are partial cutaway exploded perspective views of the skateboard illustrated in FIG. 1.
Figure 3:
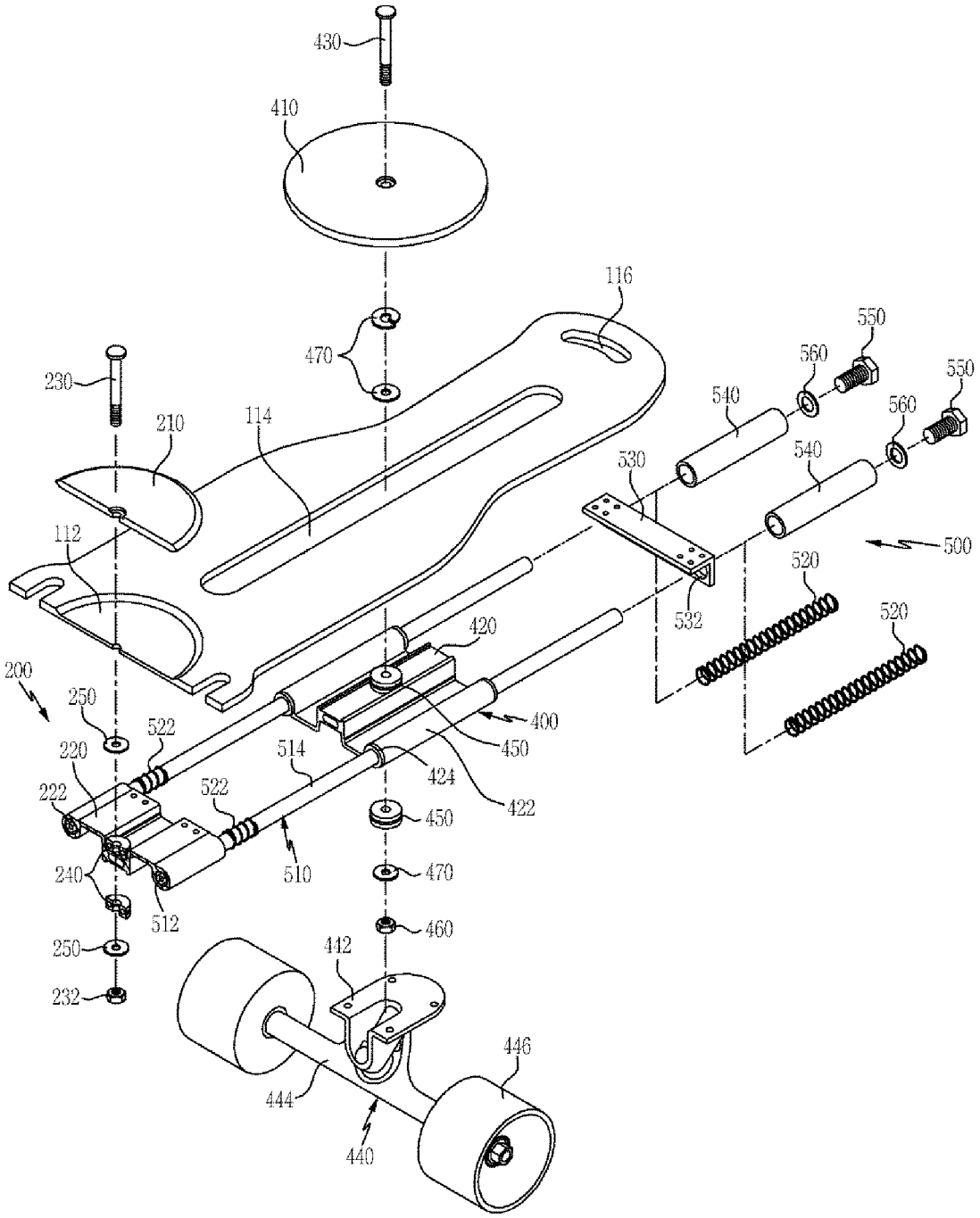
Figure 4:
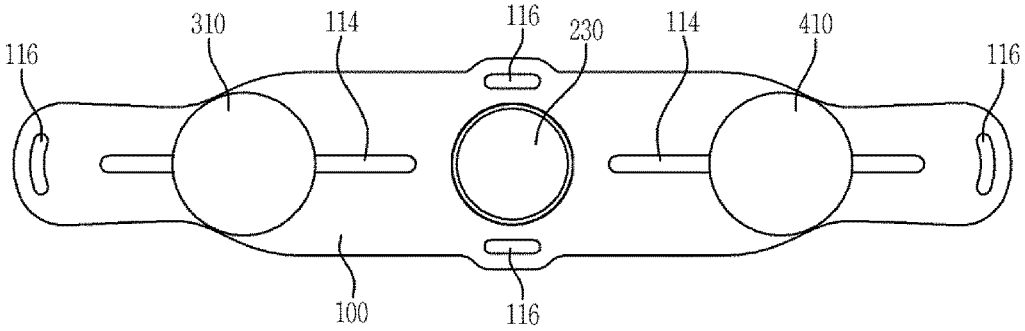
FIG. 4 is a plan view of the skateboard according to the present invention.

FIG. 1 is a perspective view of a skateboard capable of providing a self-propulsive force according to an embodiment of the present invention, FIGS. 2 and 3 are partial cutaway exploded perspective views of the skateboard illustrated in FIG. 1, and FIG. 4 is a plan view of the skateboard according to the present invention.

Figure 5:
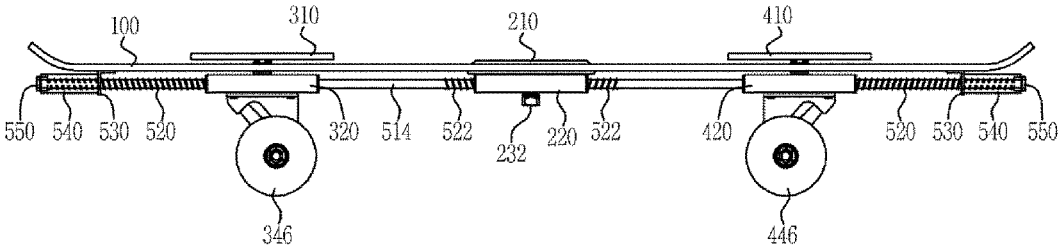
FIG. 5 is a front view illustrating a compressed state of a large coil spring in the skateboard according to the present invention.
Figure 6:
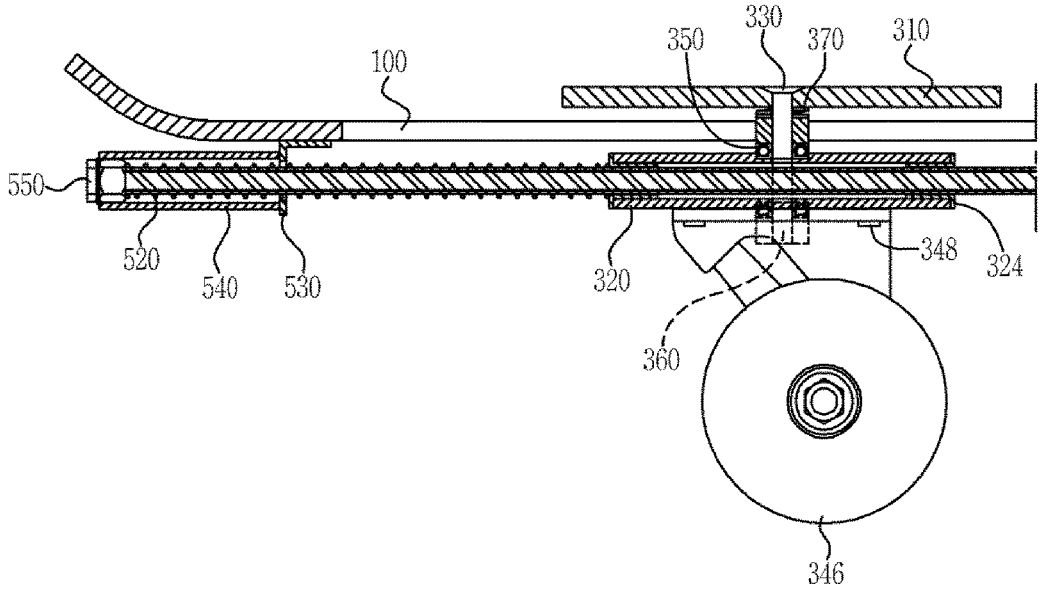
FIG. 6 is a partial enlarged cross-sectional view of a region where a first footrest portion is installed in the skateboard according to the present invention.
Figure 7:
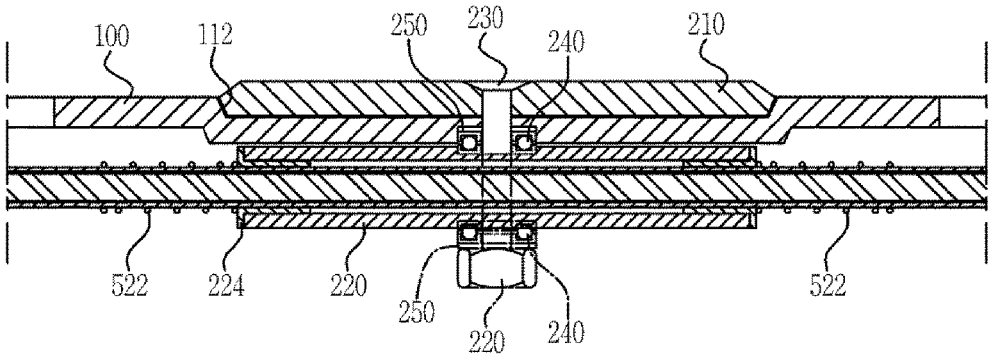
FIG. 7 is an enlarged cross-sectional view of a region where a center rotation portion is installed in the skateboard according to the present invention.

Also, FIG. 5 is a front view illustrating a compressed state of a large coil spring in the skateboard according to the present invention, FIG. 6 is a partial enlarged cross-sectional view of a region where a first footrest portion is installed in the skateboard according to the present invention, and FIG. 7 is an enlarged cross-sectional view of a region where a center rotation portion is installed in the skateboard according to the present invention.

Figure 8:
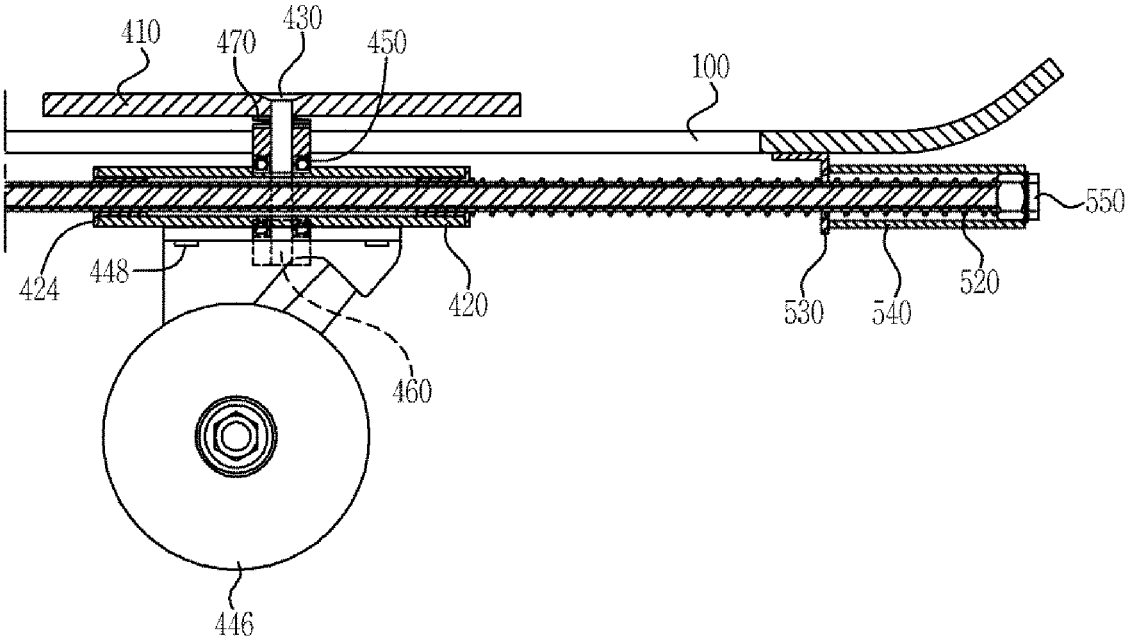
FIG. 8 is a partial enlarged cross-sectional view of a region where a second footrest portion is installed in the skateboard according to the present invention.
Figure 9:
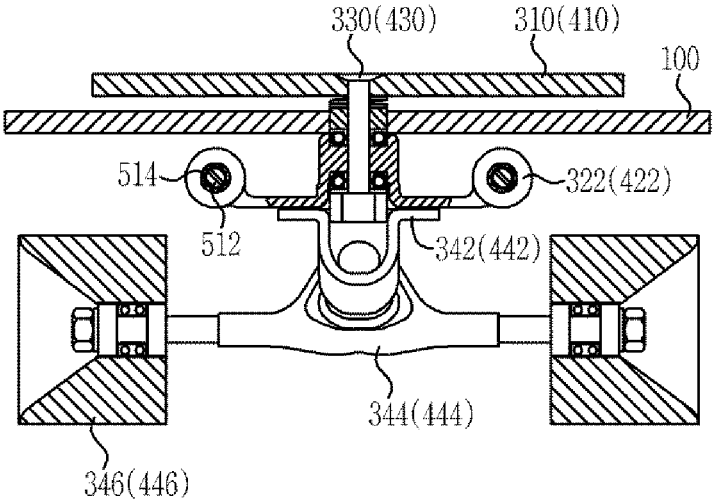
FIG. 9 is a side cross-sectional view of a region where the first footrest portion and the second footrest portion are installed in the skateboard according to the present invention.
Figure 10:
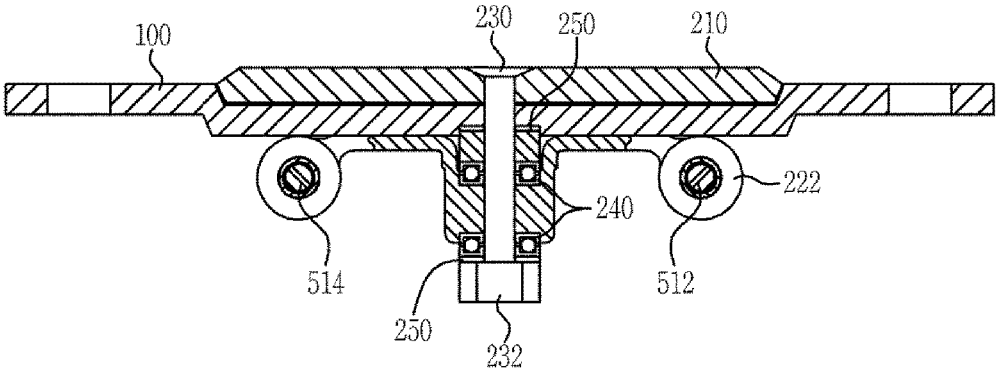
FIG. 10 is a side cross-sectional view of a region where the center rotation portion is installed in the skateboard according to the present invention.

Also, FIG. 8 is a partial enlarged cross-sectional view of a region where a second footrest portion is installed in the skateboard according to the present invention, FIG. 9 is a side cross-sectional view of a region where the first footrest portion and the second footrest portion are installed in the skateboard according to the present invention, and FIG. 10 is a side cross-sectional view of a region where the center rotation portion is installed in the skateboard according to the present invention.

Figure 11:
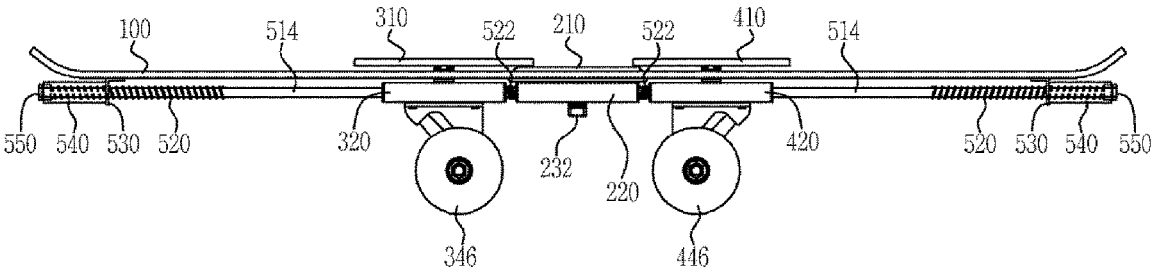
FIG. 11 is a front view illustrating a restored state of the large coil spring in the skateboard according to the present invention.
Figure 12:
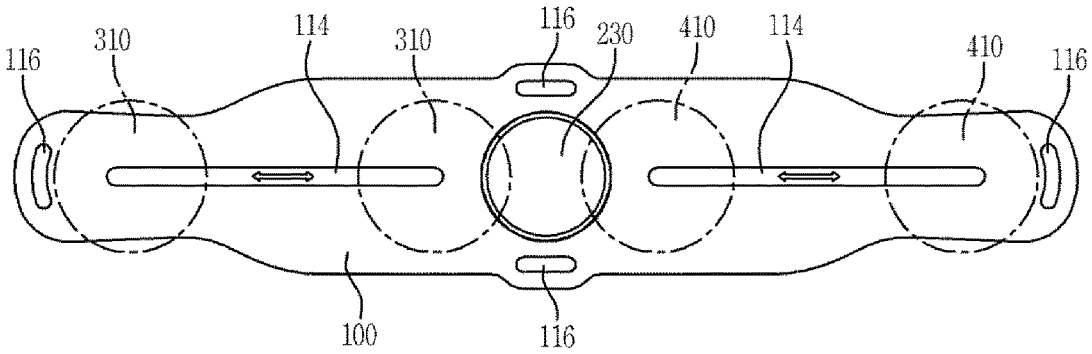
FIG. 12 is a plan view illustrating a right/left movement state of the footrests in the skateboard according to the present invention.

Also, FIG. 11 is a front view illustrating a restored state of the large coil spring in the skateboard according to the present invention, and FIG. 12 is a plan view illustrating a left/right movement state of the footrests in the skateboard according to the present invention.

Referring to FIGS. 1 to 12, the skateboard capable of providing a self-propulsive force according to the embodiment of the present invention includes a board main body 100, a center rotation portion 200, a first footrest portion 300, a second footrest portion 400, and an elastic guide portion 500.

Referring to FIG. 1, the board main body 100 has an elongated plate shape. A user stands on the board main body 100 with his or her feet on a plurality of footrests 310 and 410 described below. Both left and right end portions of the board main body 100 are curved upward in consideration of the external appearance. In a center portion of the board main body 100, an installation recess 112 having a circular shape is formed with a certain depth, such that a rotation plate 210 is installed in the installation recess 112. Guide holes 114 having an elliptical shape are formed, with the installation recess 112 being interposed between the guide holes 114, and the footrests 310 and 410 are respectively installed in the guide holes 114. Grip holes 116 are respectively formed in edge portions of the board main body 100, such that a user carries the skateboard by putting his or her hands in the grip hole and gripping the skateboard board.

In other words, when seen in a plan view, the grip holes 116 are formed at upper and lower sides of the installation recess 112 and right and left sides of the guide hole 114. In this case, the number of the grip holes 116 is not limited to four and the number of the grip holes 116 can be one, two, three, or four.

Referring to FIGS. 1 to 3, the center rotation portion 200 allows the user of the skateboard to step thereon and turn a direction of the skateboard. The center rotation portion 200 includes a rotation plate 210, a support member 220, a bolt member 230, a nut member 232, and a plurality of thrust bearings 240.

In other words, the rotation plate 210 having a diameter of 150 mm is installed on the installation recess 112, and the bolt member 230 passes through the rotation plate 210 and the support member 220 and is fastened to the nut member 232, such that the rotation plate 210 is pivotable by 360 degrees.

In the support member 220, the thrust bearings 240 through which the bolt member 230 passes are provided on upper and lower sides of a center portion of the support member 220. In the support member 220, hollow wing portions 222 for allowing rod assemblies 510 described below to pass therethrough are integrally formed in both right and right end portions. An upper side of the support member 220 is fixed to the board main body 100 through a plurality of screws (not illustrated).

When the center rotation portion 200 does not include the thrust bearing 240, the rotating function may not be implemented. In other words, if necessary, only a fixing function is implemented, while the rotating function is not implemented.

Referring to FIGS. 1, 2, and 6, the first footrest portion 300 is provided on one side of the board main body 100 with respect to the center portion thereof. The first footrest portion 300 allows the board main body 100 to move through a left and right reciprocating movement of the footrest 310. In the first footrest portion 300, the footrest 310 itself can rotate. The first footrest portion 300 includes the footrest 310, a support member 320, a bolt member 330, a wheel assembly 340, a plurality of thrust bearings 350, a nut member 360, and a washer 370.

In other words, the footrest 310 having a circular shape and a diameter of 200 mm is installed in one guide hole 114. The bolt member 330 passes through the footrest 310 and the support member 320 and is fastened to the nut member 360.

In this case, in the support member 320, the thrust bearings 350 through which the bolt member 330 passes are provided on upper and lower sides of a center portion of the support member 320. In the support member 320, hollow wing portions 322 for allowing rod assemblies 510 described below to pass therethrough are integrally formed in both left and right end portions. Therefore, the footrest 310 is pivotable on the upper side of the support member 320.

In the wheel assembly 340, a horizontal extension portion 342, which is provided on an upper side of the wheel assembly 340 and has a U-shaped cross-sectional shape, is coupled to a lower surface of the support member 320 through a plurality of screws (348 in FIG. 6). Wheels 346 are connected via bearings (not illustrated) at both left and right end portions of a main body 344 which is integrally formed with the horizontal extension portion 342, such that the wheels 346 are pivotable. In this case, it is preferable that the bearing described above be a needle clutch bearing which allows one-direction rotation.

When the first footrest portion 300 does not include the thrust bearing 350, the rotating function may not be implemented. In other words, if necessary, only the fixing function is implemented, while the rotating function is not implemented.

Referring to FIGS. 1, 3, and 7, the second footrest portion 400 is provided on the other side of the board main body 100 with respect to the center portion thereof. The second footrest portion 400 allows the board main body 100 to move through a left/right reciprocating movement of the footrest 410. In the second footrest portion 400, the footrest 410 itself can rotate. The second footrest portion 400 includes the footrest 410, a support member 420, a bolt member 430, a wheel assembly 440, a plurality of thrust bearings 450, a nut member 460, and a washer 470.

In other words, the footrest 410 having a diameter of 200 mm is installed on the other guide hole 114. The bolt member 430 passes through the footrest 410 and the support member 420 and is fastened to the nut member 460.

In this case, in the support member 420, the thrust bearings 450 through which the bolt member 430 passes are provided on upper and lower sides of a center portion of the support member 420. In the support member 420, hollow wing portions 422 for allowing rod assemblies 510 described below to pass therethrough are integrally formed in both left and right end portions. Therefore, the footrest 410 is pivotable on the upper side of the support member 420.

In the wheel assembly 440, a horizontal extension portion 442, which is provided on an upper side of the wheel assembly 440, is fixed to a lower surface of the support member 420 through a plurality of screws (448 in FIG. 8). Wheels 446 are connected via bearings (not illustrated) at both left and right end portions of a main body 444 which is integrally formed with the horizontal extension portion 442, such that the wheels 446 are pivotable. In this case, it is preferable that the bearing described above be a needle clutch bearing which allows one-direction rotation.

When the second footrest portion 400 does not include the thrust bearing 450, the rotating function may not be implemented. In other words, if necessary, only the fixing function is implemented, while the rotating function is not implemented.

Referring to FIGS. 2 and 3, the elastic guide portion 500 is provided between the board main body 100 and the wheel assemblies 340 and 440. The elastic guide portion 500 guides the left/right reciprocating movement of the support members 220, 320, and 420. The elastic guide portion 500 includes the rod assembly 510, a large coil spring 520, a small coil spring 522, a closure member 530, a spring accommodation member 540, a bolt member 550, and a nut member 560.

The rod assemblies 510 are provided with one pair on the left and right sides. In each of the rod assemblies 510, a rod-shaped core material 512 which is made of aluminum (Al) is inserted into a hollow guider 514 which is made of stainless steel (SUS) and has a diameter greater than that of the core material 512. The guider 514 passes through the wing portions 222, 322, and 422 of the support members 220, 320, and 420. The core material 512 serves to increase the durability of the guider 514 within the guider 514.

Furthermore, threaded holes (not illustrated) are respectively formed in both end portions of the guider 514, such that the bolt member 550 described below is screwed into the threaded hole.

In this case, a reduction in the weight of the rod assembly 510 is the reason why the core material 512 is made of aluminum and the guider 514 is made of stainless steel. The rod assembly 510 may be provided with a single structure made of stainless steel, instead of the assembly of the core material 512 and the guider 514.

In addition, synthetic resin bushings (see 324 and 424) having a T-shaped cross-sectional shape may be respectively inserted into both right and left end portions of the support members 320 and 420, such that the left/right reciprocating movement of the guider 514 is smoothly performed. Furthermore, bushings (see 224 in FIG. 7) may be used in the other support member 220.

The large coil springs 520 are provided to respectively surround both outer circumference surfaces of the guider 514. One end portion of the large coil spring 520 is in contact with the closure member 530 described below and the other end portion of the large coil spring 520 is in contact with an outer end portion of the support member 320 or 420.

In addition, the small coil springs 522 are provided on both end portions of the support member 220 so as to respectively surround both outer circumference surfaces of the guider 514. The small coil springs 522 prevents the support member 320 and 420 from coming into direct contact with the support member 220 during the left/right reciprocating movement of the support member 320 and the 420. Furthermore, the elastic action of the small coil springs 522 makes the support member 320 or 420 move smoothly.

The closure member 530 has an ¬ -shaped cross-sectional shape, and through-holes 532 are provided in both left and right end portions of the closure member 530. Thus, a part of the guider 514 passes through the through-hole 532 and is then accommodated in the spring accommodation member 540 described below together with the large coil spring 520. An upper surface of the closure member 530 is fixed to the board main body 100 through a plurality of screws (not illustrated).

The spring accommodation member 540 has a hollow cylindrical shape. A tip portion of the spring accommodation member 540 is fixed to the closure member 530 by welding. The guider 514 passes through the closure member 530 and is fastened to the bolt member 550 in the spring accommodation member 540. In other words, the guider 514 sequentially passes through the closure member 530 and the spring accommodation member 540 and the guider 514 is fastened to the bolt member 550.

Although not illustrated in the drawings, a brake function may be added to the skateboard according to the present invention. In other words, a friction member (not illustrated), which is made of a urethane material and has a height of 80 mm, may be fastened to a lower surface of the board main body 100 between both spring accommodation members 540 through a bolt member. In this case, if necessary, when a user presses a front side or a rear side of the board main body 100 by his or her feet, the friction member comes into contact with the ground, so that the speed of the skateboard is reduced. In FIGS. 2 and 3, reference numerals 250, 370, and 470 represent washers.

Hereinafter, the operation of the skateboard having the above structure according to the present invention will be described.

Referring to FIG. 12, the footrests 310 and 410, the support members 320 and 420, and the wheel assemblies 340 and 440 of the skateboard according to the present invention move through the guide holes 114 to the vicinity of the rotation plate 210 by a restoring force of the large coil spring 520 and cover a part of the rotation plate 210.

In such a state, a user grips the board main body 100 through the grip hole 116 and moves to a desired location. Next, the user places the skateboard on the ground and puts his or her feet on the footrests 310 and 410. Then, when the user repeats spreading and closing movement of his or her feet, the support members 320 and 420 move along the outer circumference surface of the guider 514, and thus, the gap between the support members 320 and 420 increases or decreases with respect to the support member 220 of the center rotation portion 200. At this time, the wheels 346 and 446 rotate in accordance with compression or restoration of the large coil spring 520. In this way, the skateboard moves in one direction (that is, a forward direction).

In other words, the skateboard can be moved by a self-propulsive force generated when the user repeats the spreading and closing movement of his or her feet while the user puts his or her feet on the footrests 310 and 410.

In this case, the bearings used for the wheel assemblies 340 and 440 are needle clutch bearings capable of one-direction rotation, and thus, when the user sequentially repeats the spreading and closing movement of his or her feet while the user puts his or her feet on the footrests 310 and 410, the gap between the footrests 310 and 410 decreases or increases. In addition, when the user rapidly performs the spreading and closing movement of his or her feet, the propulsive force further increases. As a result, the rotating speed of the wheels 346 and 446 in one direction (that is, the forward direction) increases, thereby increasing the moving speed of the skateboard.

In addition, in a case where the user repeats the spreading and closing movement of his or her feet while the user puts his or her feet on the footrests 310 and 410, if the gap between the feet is relatively large, it is possible to turn the board main body 100 at a relatively large rotation angle and, further, if the gap between the feet is relatively small, it is possible to turn the board main body 100 at a relatively small rotation angle. As a result, when the user rides the skateboard, it is possible to perform a sharp turn or a gentle turn.

On the other hand, in a case where the user is dextropedal, when the user wants to change a traveling direction of the skateboard during skateboarding, one foot, that is, a left foot put on the footrest 310 of the first footrest portion 300, is moved to the pivotable rotation plate 210 and the user turns his or her body by 180 degrees. Next, the user raises his or her right foot put on the footrest 410 of the second footrest portion 400, and puts his or her right foot on the footrest 310 of the first footrest portion 300. Then, as the user repeats the spreading and closing movement of his or her feet as described above, the large coil spring 520 is compressed or restored and simultaneously the wheels 346 and 446 rotate to move the skateboard in the other direction (that is, a rearward direction). Consequently, it is possible to change the traveling direction of the skateboard to an opposite direction.

According to the embodiment of the present invention, in the above-described operations, the movement of the skateboard is performed by repeating the spreading and closing movement of the feet while the feet are put on the footrests 310 and 410 on the board main body 100. Accordingly, it is possible to solve inconvenience that the user has to repeatedly kick the ground with one foot while the other foot is put on the skateboard so as to obtain a propulsive force.

In addition, since the user need not continuously kick the ground with one foot, it is possible to reduce risk of the safety accident and prevent the user from getting easily tired when the user rides the skateboard.

In addition, since the movement of the skateboard is performed by repeating the spreading and closing movement of the feet while the feet are put on the footrests 310 and 410 on the board main body 100, the user can easily maintain his or her balance when riding the skateboard, and thus, any persons can easily enjoy skateboarding regardless of age.

In addition, the moving speed of the skateboard can be increased by increasing the rotating speed of the wheels 346 and 446 by way of rapidly repeating the spreading and closing movement of the foot put on the footrests 310 and 410.

In addition, it is possible to strengthen a thigh muscle, which is a symbol of good health of adult men and women, by repeating the spreading and closing movement of feet.

In addition, since the rotation plate 210 and the footrests 310 and 410 have the pivotable structures, the user can frequently turn his or her posture (180 degrees) if necessary, and thus, the user can variously change his or her posture while the user rides the skateboard.

In addition, when the user rides the skateboard, the user can change the travelling direction of the skateboard in an opposite direction in such a manner that the user raises his or her left foot put on the footrest 310 of the first footrest portion 300, puts his or her left foot on the rotation plate 210, turns his or her body by 180 degrees, raises his or her right foot put on the footrest 410 of the second footrest portion 400, and puts his or her right foot on the footrest 310 of the first footrest portion 300.

While the skateboard capable of providing the self-propulsive force according to the present invention has been described with referring to the accompanying drawings, it will be apparent to those skilled in the art that the present invention is not limited to the embodiments and drawings set forth herein and various modifications and changes may be made thereto without departing from the spirit and scope of the present invention.

DESCRIPTION OF REFERENCE NUMERALS

| | |
|---|---|
| 100: board main body | 112: installation recess |
| 114: guide hole | 116: grip hole |
| 200: center rotation portion | 210: rotation plate |
| 220, 320, 420: support member | 222, 322, 422: wing portion |
| 300: first footrest portion | 310, 410: footrest |
| 340, 440: wheel assembly | 346, 446: wheel |
| 400: second footrest portion | 500: elastic guide portion |
| 510: rod assembly | 520: large coil spring |
| 522: small coil spring | 530: enclosure member |
| 532: through-hole | 540: spring accommodation member |

What is claimed is:

1. A skateboard capable of providing a self-propulsive force, the skateboard comprising:

a board main body on which a user stands with his or her feet, wherein an installation recess having a certain depth is formed in a center portion, and guide holes are formed, with the installation recess being interposed between the guide holes;

a center rotation portion which allows the user of the skateboard to change a direction of the skateboard with one foot put thereon, the center rotation portion including:

a rotation plate which is installed in the installation recess of the board main body;

a support member in which thrust bearings are installed on upper and lower sides of a center portion thereof, and hollow wing portions are integrally formed in both left and right end portions thereof; and a bolt member which passes through the rotation plate and the support member and is fastened to a nut member;

a first footrest portion which is provided on one side of the board main body with respect to the center portion and moves the board main body through a left and right reciprocating movement of the footrest, the first footrest portion including:

a footrest which is installed in the guide hole on one side of the board main body;

a support member in which thrust bearings are installed in upper and lower side of a center portion thereof, and hollow wing portions are integrally formed in both left and right end portions thereof;

a bolt member which passes through the footrest and the support member and is fastened to a nut member; and a wheel assembly in which a horizontal extension portion in an upper portion is fastened to a lower surface of the support member and wheels are pivotally provided in both left and right end portions of a main body of the wheel assembly integrally formed with the horizontal extension portion;

a second footrest portion which is provided on the other side of the board main body with respect to the center portion and moves the board main body through a left/right reciprocating movement of the footrest, the second footrest portion including:

a footrest which is installed in the guide hole on the other side of the board main body;

a support member in which thrust bearings are installed in upper and lower sides of a center portion thereof and hollow wing portions are integrally formed in both left and right end portions thereof;

a bolt member which passes through the footrest and the support member and is fastened to a nut member; and a wheel assembly in which a horizontal extension portion in an upper portion is fastened to a lower surface of the support member, and wheels are pivotally provided in both left and right end portions of a main body of the wheel assembly integrally formed with the horizontal extension portion; and an elastic guide portion which is provided between the board main body and the wheel assemblies and guides left/right reciprocating movements of the support members.

2. The skateboard of claim 1, wherein the both left and right end portions of the board main body are bent and curved upward.

3. The skateboard of claim 2, wherein at least one grip hole is provided in an edge portion of the board main body to allow a user to move the skateboard by putting his or her hands in the grip hole and gripping the skateboard.

4. The skateboard of claim 1, wherein synthetic resin bushings are respectively inserted into both left and right end portions of the support members, such that a left/right reciprocating movement of a guider is smoothly performed.

5. The skateboard of claim 1, wherein the elastic guide portion comprises:

a core material which has a rod shape and is made of aluminum;

a guider which is made of stainless steel and into which the core material is inserted;

a large coil spring and a small coil spring which respectively surround outer circumference surfaces of the guider;

a closure member and a spring accommodation member through which the guider sequentially passes; and a bolt member which is fastened to the guider.

* * * * *